US006216899B1

(12) United States Patent
Vicari

(10) Patent No.: US 6,216,899 B1
(45) **Date of Patent: *Apr. 17, 2001**

(54) DISMOUNTABLE CONTAINER

(76) Inventor: Edda Dorothy Bragazza Vicari, Rua Alvaro Luiz Roberto Assumpcao, 321-4° andar, 04618-021, Sao Paulo (BR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/380,388

(22) PCT Filed: Dec. 22, 1998

(86) PCT No.: PCT/BR98/00110

§ 371 Date: Aug. 27, 1999

§ 102(e) Date: Aug. 27, 1999

(87) PCT Pub. No.: WO99/35043

PCT Pub. Date: Jul. 15, 1999

(30) Foreign Application Priority Data

Dec. 30, 1997 (BR) ..... 9706337
Sep. 21, 1998 (BR) ..... 9706337

(51) Int. Cl.[7] ..... B65D 88/00

(52) U.S. Cl. ..... 220/1.5; 220/4.29; 220/4.32; 220/4.33; 206/600; 217/56; 217/16

(58) Field of Search ..... 217/56, 16, 13; 206/600; 220/1.5, 4.29, 4.32, 4.33, 4.34, 6, 621, 692, 693

(56) References Cited

U.S. PATENT DOCUMENTS

| | | | | |
|---|---|---|---|---|
| 753,889 | * | 3/1904 | Jones | 292/57 |
| 1,209,027 | * | 12/1916 | Quade | 217/12 R |
| 1,231,977 | * | 7/1917 | Winship | 217/16 |
| 1,894,022 | * | 1/1933 | Cruser | 217/56 |
| 2,650,737 | * | 9/1953 | Geyer et al. | 220/1.5 |
| 3,401,814 | * | 9/1968 | Chiswell et al. | 220/1.5 |
| 3,451,578 | | 6/1969 | Edmundson | 217/48 |
| 4,186,841 | * | 2/1980 | Buckley et al. | 220/1.5 |
| 4,693,386 | * | 9/1987 | Hughes et al. | 220/1.5 |
| 5,161,709 | * | 11/1992 | Oestreich, Jr. | 220/6 |
| 5,638,973 | * | 6/1997 | Dewey et al. | 220/4.33 |
| 5,669,507 | * | 9/1997 | Pruitt, Jr. | 206/600 |
| 6,019,226 | * | 2/2000 | Zajdlik et al. | 206/600 |

FOREIGN PATENT DOCUMENTS

| | | | |
|---|---|---|---|
| 43 62730 A1 | 10/1994 | (DE) | B65D/6/26 |
| 29704617 | 8/1997 | (DE) | B65D/88/52 |
| 2624831 | 6/1989 | (FR) | B65D/6/18 |
| 2661656 | 11/1991 | (FR) | B65D/19/14 |
| 303050 | 12/1928 | (GB) . | |
| 2028266 | 3/1980 | (GB) | B65D/19/06 |

* cited by examiner

*Primary Examiner*—Paul T. Sewell
*Assistant Examiner*—Troy Arnold
(74) *Attorney, Agent, or Firm*—Abelman Frayne & Schwab

(57) ABSTRACT

The present invention refers to a box for transporting and storing different products, which is made of wood and can be fully assembled and disassembled. The box is suitably used for transporting pieces and automotive parts for long distances. The improved box comprises a pallet type bottom plate (10), side plates (20) and upper cover (30), said side plates (20) being coupled (i) together by means of pairs of hinges (24; 25), (ii) to bottom plate (10) by means of pairs of parts (27; 28) in the lower portion that cooperate with the respective pairs of parts (12'; 13') of said bottom plate (10) and (iii) to cover (30) by means of latches (20'; 30'). In a first embodiment of the present invention, all said pairs of hinges (24; 25), pairs of parts (27; 28) of side plates and said pairs of parts (12'; 13') of bottom plate (10) face the interior of said box. In a second preferred embodiment of the present invention, only one of hinges (240; 250) faces the outer part of the box, but both joints (230'; 240') and rod (400) are accessed through the outer part of the box.

9 Claims, 9 Drawing Sheets

FIG. 4
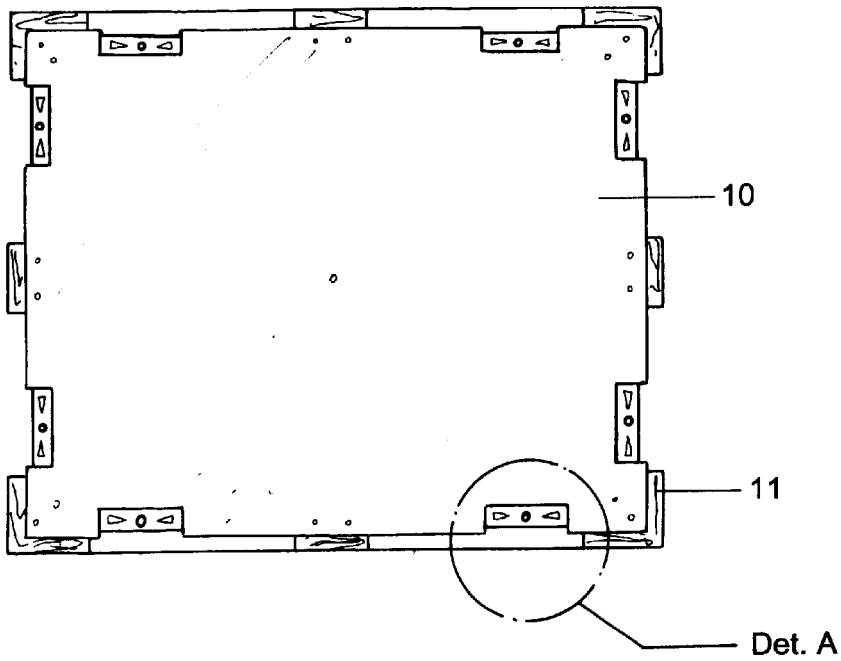
FIG. 5
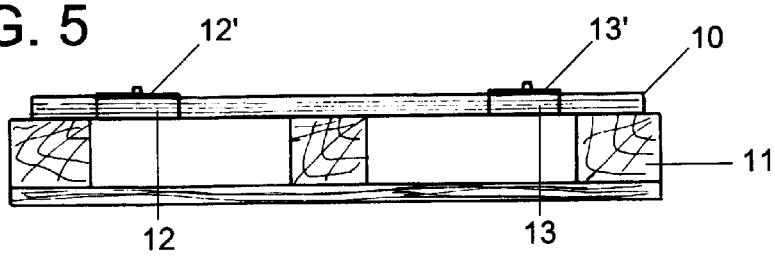
FIG. 6 - Det. A
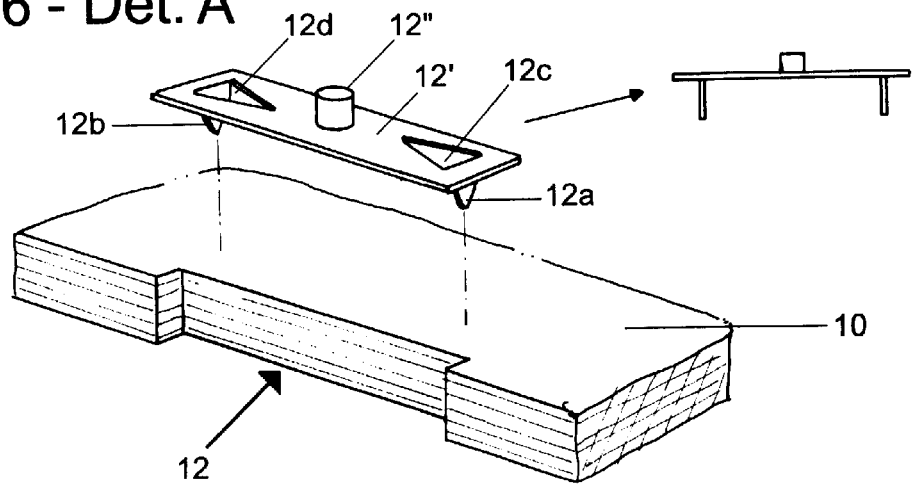

FIG. 7
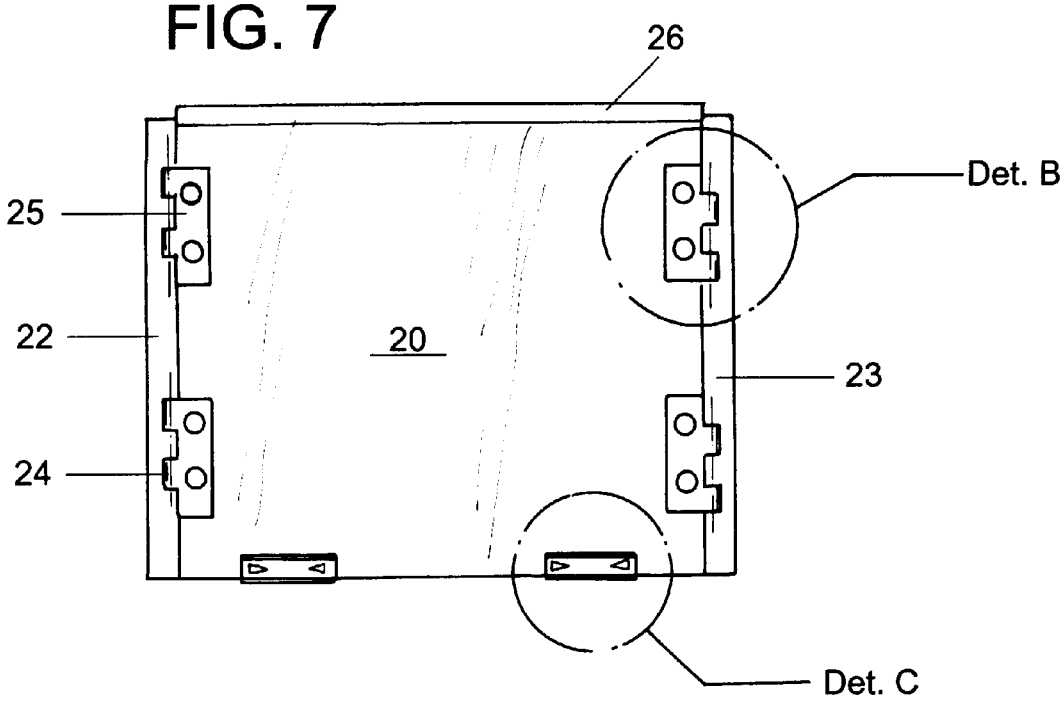
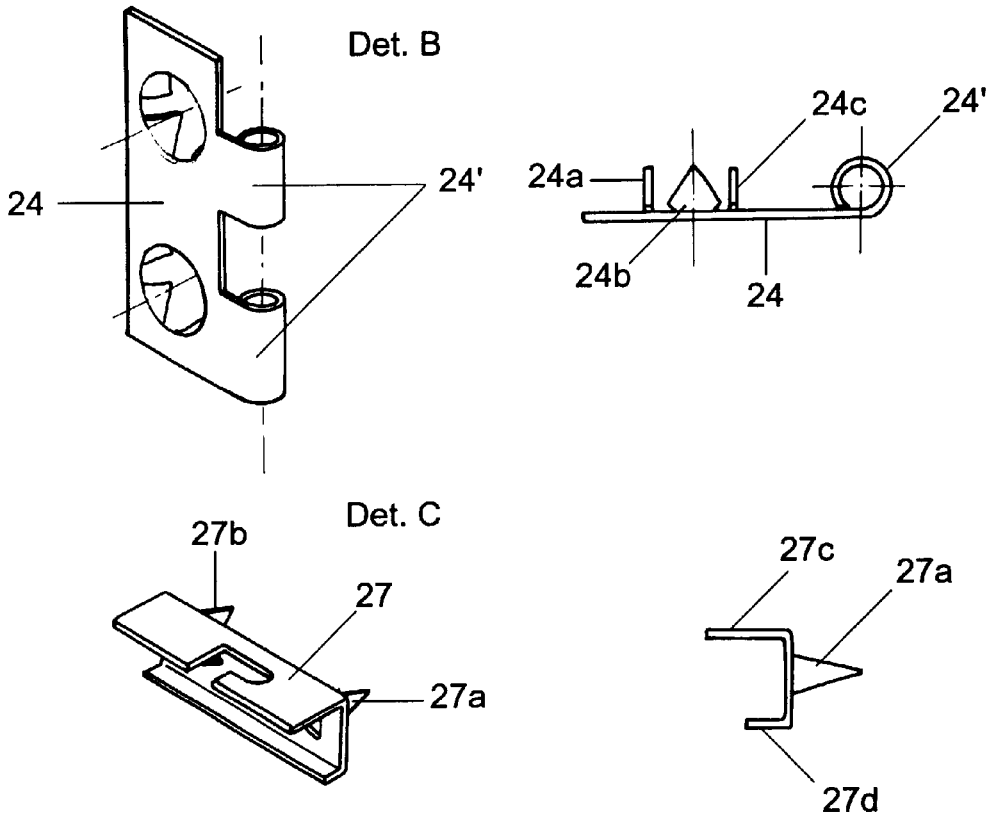

Det. A

DISMOUNTABLE CONTAINER

FIELD OF THE INVENTION

The present invention refers to a box for transporting and storing different products, manufactured or not, which can be disassembled and restored to its original shape several times.

More particularly, the present invention refers to with a wooden box which can be fully assembled and disassembled by only one person, which is adequately used for transporting pieces and automotive parts for long distances.

BACKGROUND OF THE INVENTION

The transportation of products for long distances frequently requires packing systems which are resistant and suitable to each type of material transported. Thus, for example, we have the transportation of automotive vehicle parts from the manufacturing plant to the assembling plant. The parts for assembling automotive vehicles are generally are made of metal with precision and uniformity and must get to the assembling line without any type of physical damage in their structure, mainly damages that can affect the use thereof or make them unusable, for they shall be processed in high-precision equipment in the vehicle assembling plant. Therefore, such damages as deformation of the structure, surface corrosion, scratches in parts made of plates and provided with surface treatment, and the like, are undesirable.

In view of such automotive industry demand, boxes have been developed, generally made of wood, for this is the most suitable material for that type of transportation, for satisfying all transportation needs such as safety, resistance, watertightness, as well as ability to be piled up, deformed and disassembled. However, despite those industry demands, traditional boxes that cannot be disassembled are still in use, and for such reason have a short half-life and are not cost-effective, besides being clumsy and heavy to be handled, thus making it difficult to carry same.

There are at least two types of boxes in the market which can be fully disassembled and restored to their original shape that are frequently used in the automotive industry.

The first one, developed and patented in the name of the Applicant under number BR 6200841 and marketed under trade name Vicaixa®, is provided with a base structure made of plywood and comprised of a bottom, four sides and cover which are fastened together by means of metallic angle bars having locking latches. Said angle bars are provided with teeth which are attached to the plywood surface by means of compression. The closing of the box is carried through by the locking of a latch provided in one of the sides of the pair of angle bars in a groove provided in the part in the opposing side of said pair of angle bars. A variant of that design, which can be partially disassembled, provides the joining of the sides together by means of a metallic ribbon which is also provided with teeth for attachment to the plywood surface, longitudinally positioned between each pair of sides. Said metallic ribbons make it possible to fold one side over the other.

Despite the fact that the above mentioned Vicaixa® satisfactorily fulfills the automotive industry requirements, it presents some problems connected with the maintenance and conservation thereof, since metallic parts, angle bars and ribbons are exposed over the box structure. This brings about the direct contact of metal/metal and/or metal/wood, thus damaging both the metallic parts and the wood structure of the box. However, this contact is not desirable while such boxes are transported and stored, for it causes the disruption of connecting portions of the box walls and consequently damage the product stored therein. In addition, after it is first disassembled, a traverse crease is created on the angle bar locking latch, what makes it difficult to be assembled a second time. Still, in view of the fact that the parts are made of metal, said box can only be made of 4 to 12 mm thick plywood.

The second design mentioned above, as well as improvements thereto and applications therefor, was developed by Clip-Lok International Limited, known by the trademark Clip-Lok®, is described in published patent applications PCT WO 95/13969, WO 94/25355 and WO 93/17930, in Brazilian patent application BR 9305437-8 and in GB patent GB 2 257 453. Like the above mentioned Vicaixa®, Clip-Lok® is also provided with a base structure made of plywood and comprised of in compensated bottom plates, four sides and cover fastened together by means of metallic staples or clips which can be placed under pressure into recesses provided in the surfaces of said plywood plates, thus keeping them locked to one another. After being attached, said metallic staples are removed when disassembling the box by the use of a special tool.

Said Clip-Lok® system, however, in spite of also satisfying the automotive industry needs, has its intrinsic difficulties and disadvantages. When the box is assembled, if said clips have not been suitably attached, they can slacken under pressure while being transported. An assembled box lacking a clip is a box without the required safety for transportation and storage, for it can collapse due to the inner and/or outer pressure thereon caused by the oscillation while it is transported. The clip is attached to and removed from the box under pressure and therefore such a submission makes it a short half-life part. Furthermore, said Clip-Lok® is also a box having exposed parts on its surface, what can, as already stated, cause the direct contact of metal/metal and/or metal/wood, thus damaging both the metallic parts and the wood structure of said box.

Still, a common fact with the above mentioned boxes is the lack of a suitable isolation therein of the product against external agents, such as water and/or sea water when transported by ship, which agents permeate into the box interior through its cover.

BRIEF DESCRIPTION OF THE INVENTION

Therefore, an object of the present invention is overcome the imperfections of the prior art boxes for transportation and storage mentioned above.

Another object of the present invention is to provide a box that satisfactorily fulfills the automotive industry demands for the provisional transportation and storage of parts in general.

Still another object of the present invention is to provide a long half-life highly safe watertight box having a versatile configuration with no metallic part exposed on the surface thereof.

Additionally, an object of the present invention is to provide a box that, based on the principles used for developing the state of the art Vicaixa® box described above is fully improved in its structural frame, as well as in the aspects associated with its operability, functionality and maintenance.

Those and other objects are attained by the inventive box for transportation and storage, which is basically comprised of a bottom plate, four side plates and a wood top, wherein said side plates are coupled together by means of pairs of side hinges interconnected by metallic rods.

Said side plates are coupled to the bottom plate by means of pairs of parts specially developed therefor, and to the cover by means of Velcro® type or other closures similar thereto which can be easily opened and closed.

BRIEF DESCRIPTION OF THE DRAWINGS

The objectives, improvements and technical and functional effects of the box for transportation and storage in accordance with the present invention are apparent to those skilled in the art from the accompanying schematic drawings, wherein:

FIG. 4 is a bottom plan view of the box shown in FIG. 1;

FIG. 5 is a front view of the bottom of the box shown in FIG. 1;

FIG. 6 is a detailed view of the attachment of a metallic part of the box shown in FIG. 1;

FIG. 7 is a plan view of one side of the box shown in FIG. 1 and details of the metallic parts;

DETAILED DESCRIPTION OF THE INVENTION

Figure 1:
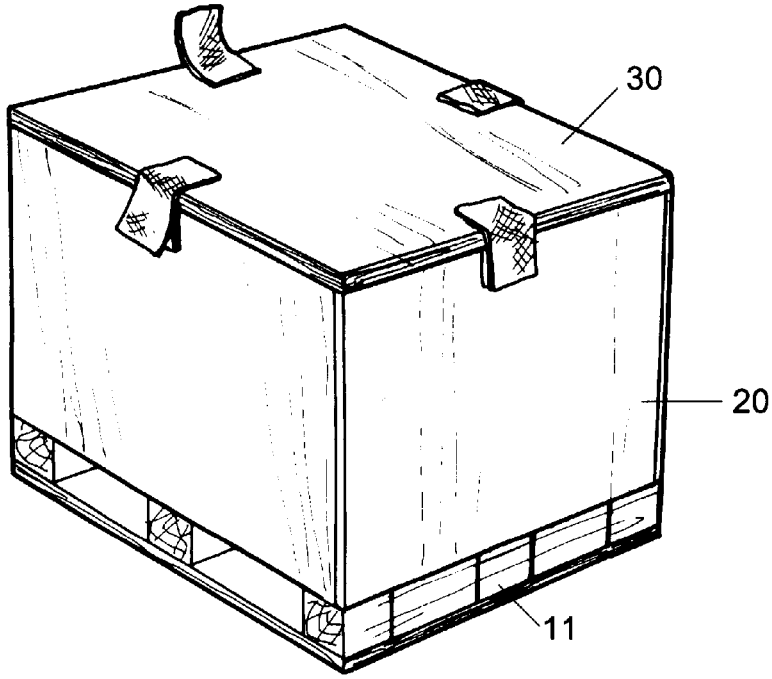
FIG. 1 is a perspective view of one embodiment of the box in accordance with the invention, in a fully closed position.
Figure 2:
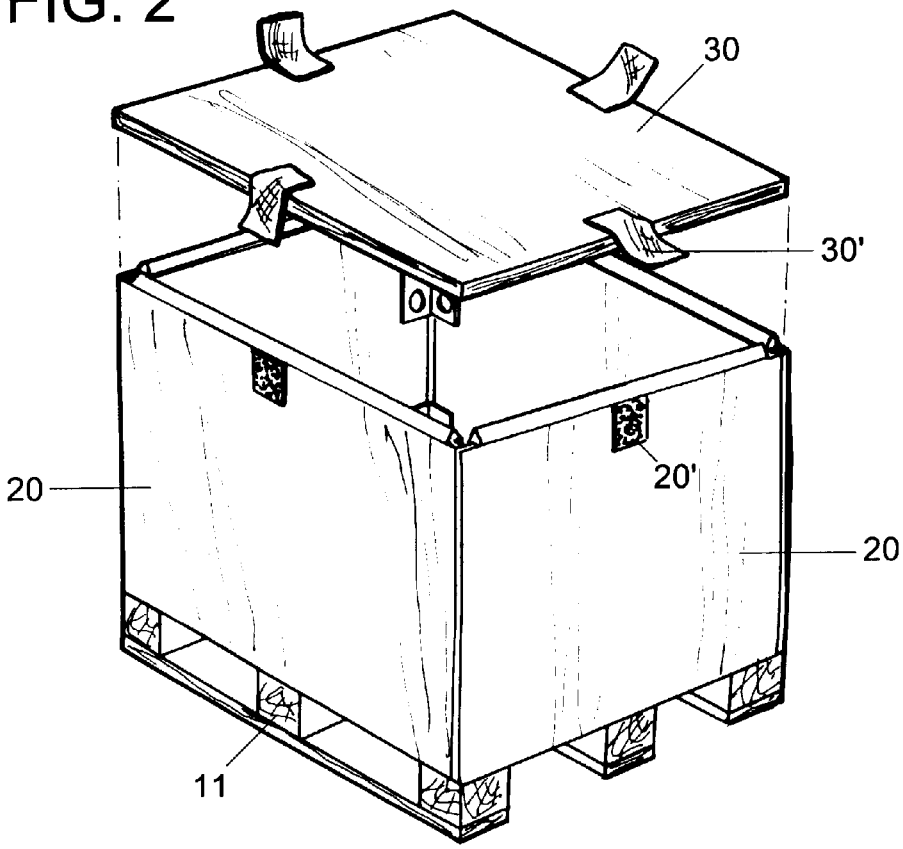
FIG. 2 is a perspective view of the same box but showing its cover raised.
Figure 3:
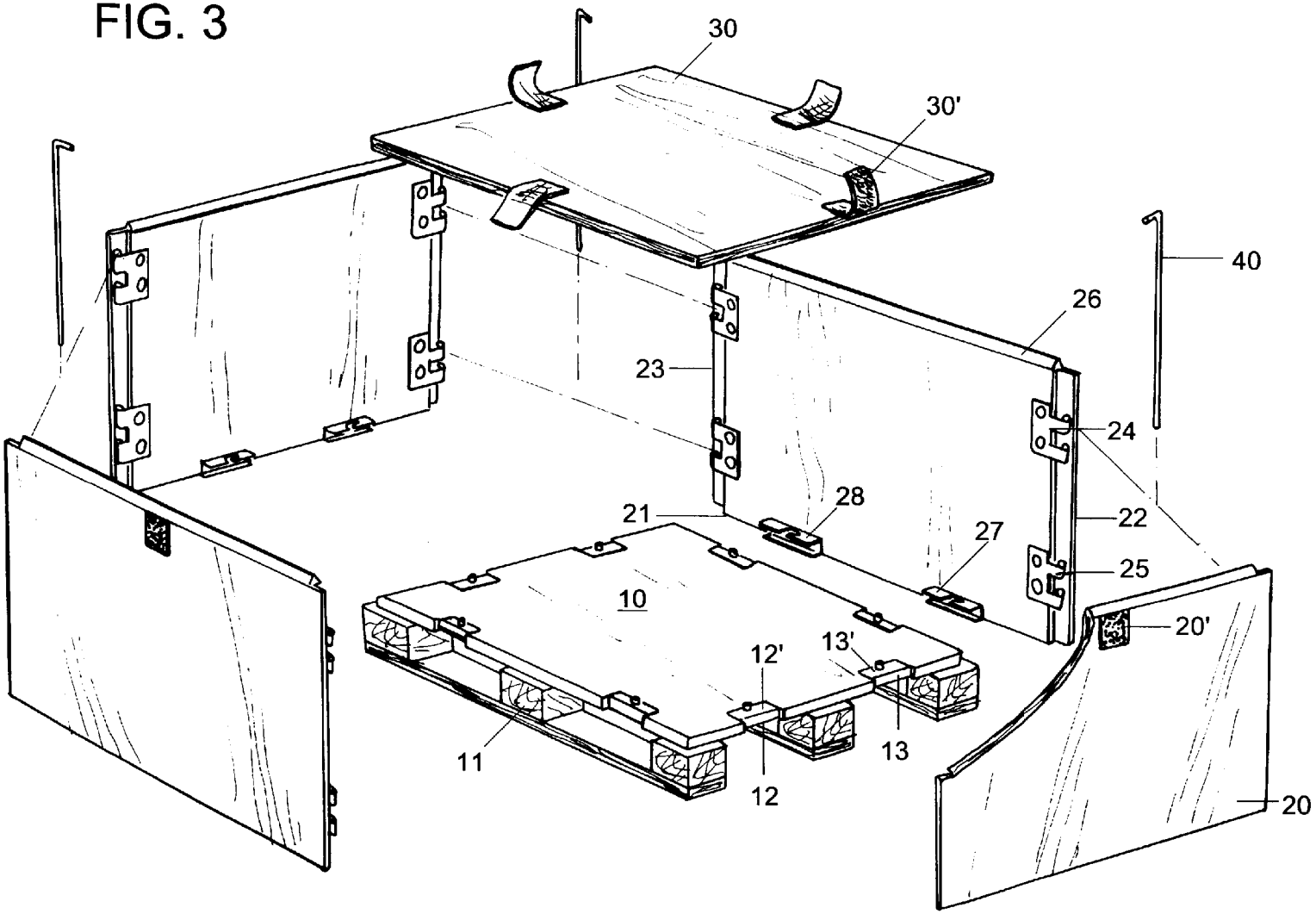
FIG. 3 is an exploded perspective view of the box shown in FIG. 1.

In accordance with FIGS. 1 to 10, which is a preferred embodiment of the box for transporting and storing products according to the present invention, the box comprises a pallet type bottom plate (10) provided with a lower support insert (11), four identical side plates (20) and an upper cover (30). Said upper cover (30) is provided with double Velcro® type latches (30') or the like in the median portions of its four ends, which latches cooperate with the respective pairs (20') provided in the upper ends of said side plates (20).

The bottom plate (10) is provided in each of its four boundary lines with two longitudinal recesses (12; 13) each of which is followed by the respective metallic locking parts (12'; 13') disposed at the boundary of said recesses (12; 13). Said metallic locking parts (12'; 13') are described in greater detail below.

Figure 10:
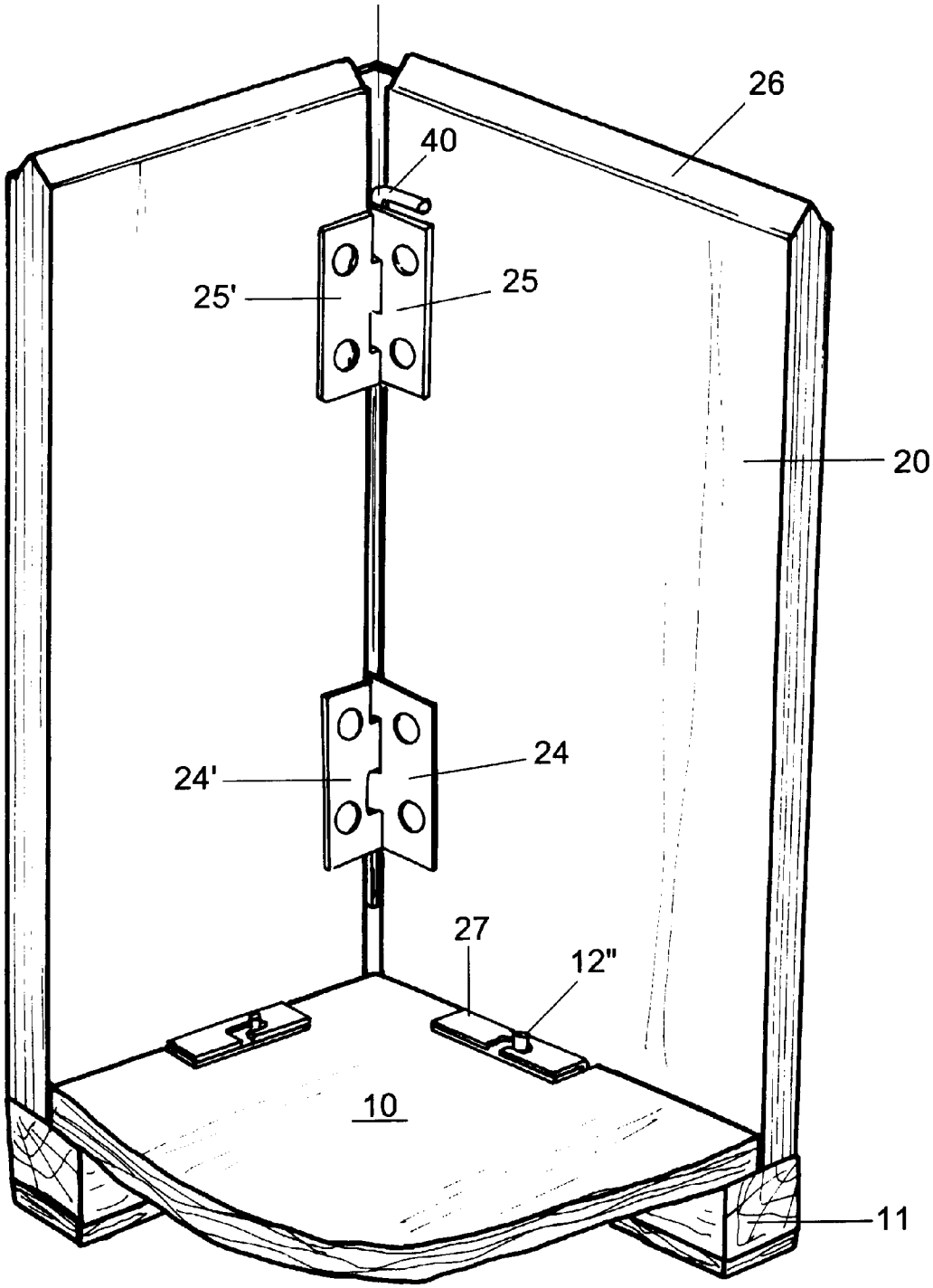
FIG. 10 is a partially exploded perspective view of the interior of the box of the present invention as illustrated in FIG. 1.
Figure 11:
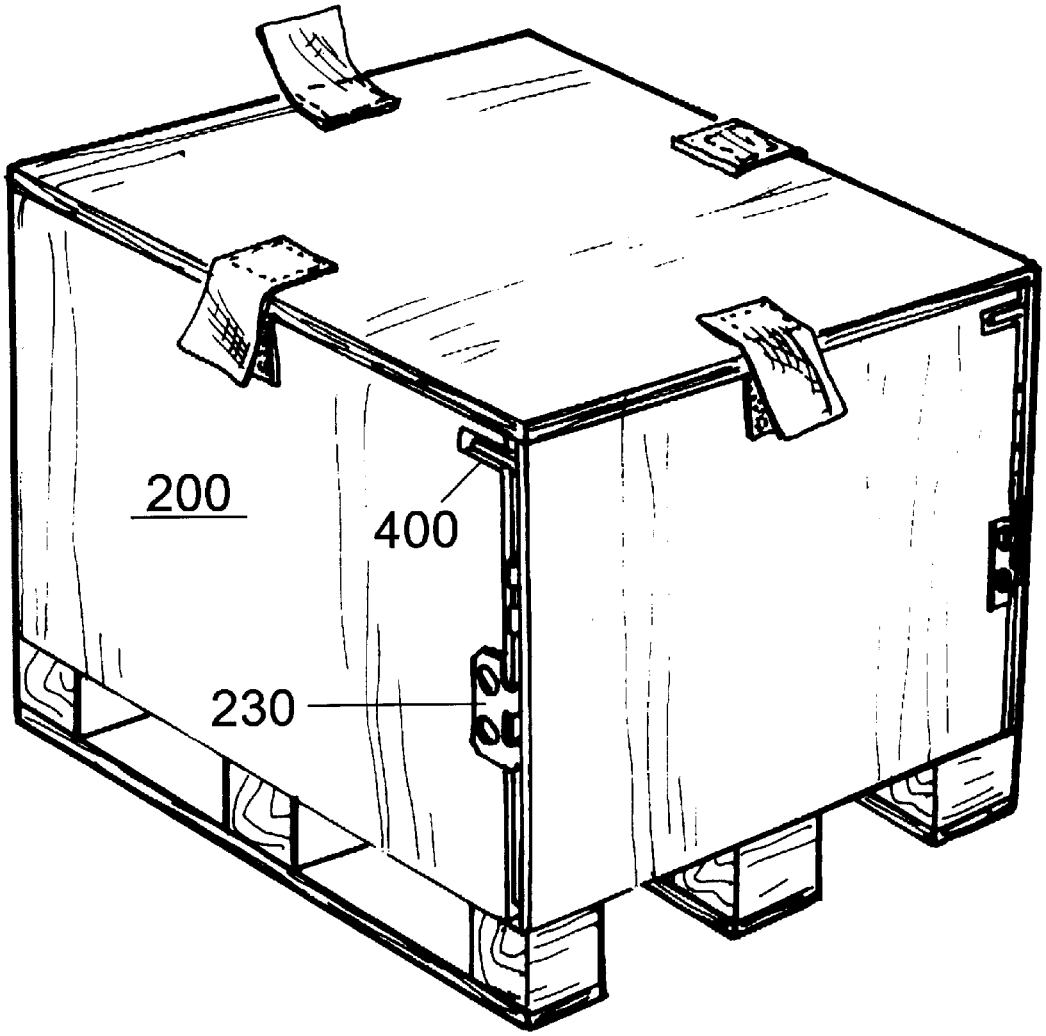
FIG. 11 is a perspective view of a preferred embodiment of the box according to the invention, in a closed position.
Figure 12:
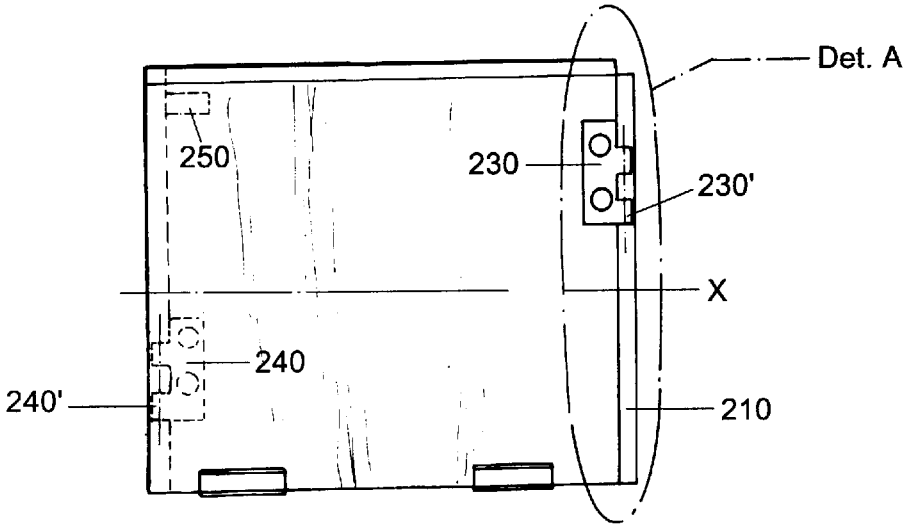
FIG. 12 is a front view of a preferred embodiment of one of the side plates.
Figure 13:
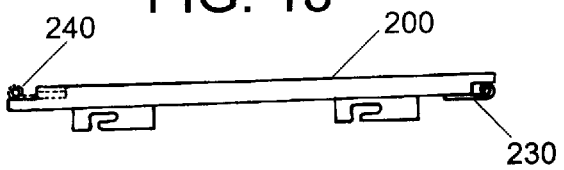
FIG. 13 is a top view of the side plate shown in FIG. 12.
Figure 14:
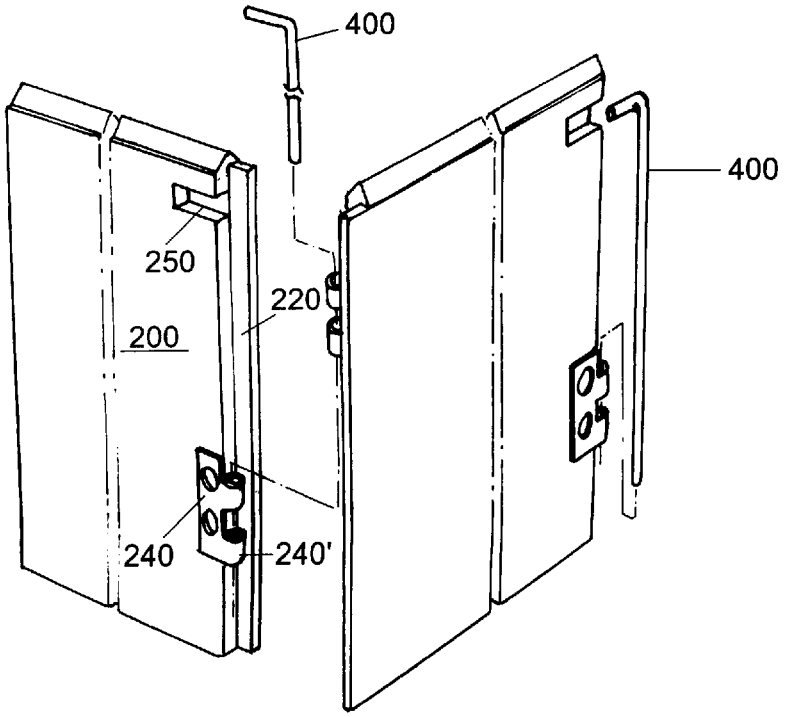
FIG. 14 is a perspective exploded view of the connection of two side plates of the preferred embodiment according to FIG. 11.

The side plates (20) which are shown in more details in FIGS. 7 and 10, have a straight base (21) to be supported on bottom insert (11) and longitudinal side recesses (22; 23) where pairs of collapsible metallic hinges (24; 25) are to be mounted, which pairs fit into the respective pairs disposed in the adjacent side plate (24'; 25'). Every two pairs of hinges aligned in the same edge of the box are then attached to each other by means of a metallic rod (40). Said metallic rod has an upper L-shaped folded end in order to be suitably handled during the assembling and disassembling operations of the box. In the upper end, said side plates (20) have a longitudinal protuberance (26) to fit into the cover (30). Additionally, each of said side plates (20) has, in its lower end, in their base boundary, two metallic parts (27; 28) that fit into the respective metallic locking parts (12'; 13') disposed in the boundary of said recesses (12; 13) of the bottom (10).

It should understood that in spite of the fact that the above features have been referred to and/or shown in one or more sides, they coexist in the remaining ones where they have not been referred to and/or shown.

More specifically in FIGS. 4, 5 and 6, the features and details of bottom (10) of the box according to the present invention can be seen, which bottom has an area lower than that of the lower support insert (11) and recesses (12; 13) provided in its four ends, in the boundary of which are parts (12'; 13'). Said parts (12'; 13') are provided with respective locking pins (12"; 13") which cooperate with respective sliding coupling parts (27; 28), thus forming a lower locking latch in side plates (20). Said parts (12'; 13') are pressure embedded onto the surface of the bottom plywood (10). FIG. 6 illustrates part (12') which is pressure embedded onto the surface of bottom (10) by means of small wedges (12*a*; 12*b*) formed by notches (12*c*; 12*d*) provided in the surface of said part (12'). The same applies to part (13'). This configuration positions the bottom plate (10) of the inventive box inside lower support insert (11).

Figure 8:
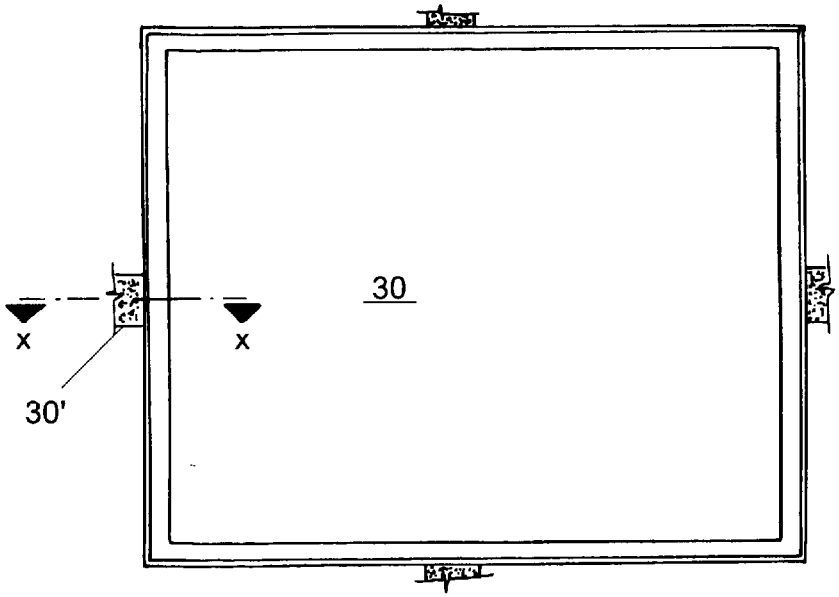
FIG. 8 is a plan view of the cover of the box shown in FIG. 1.
Figure 9:
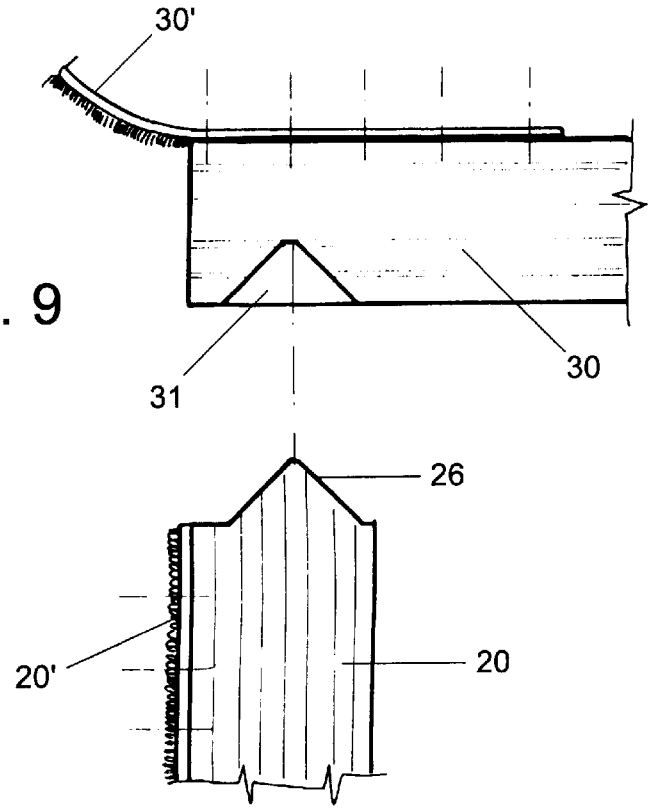
FIG. 9 is a view along cut line X—X shown in FIG. 8.

In FIG. 7 and Details B and C, a side plate (20), a hinge (24) and a sliding coupling part (27) are shown in a detailed amplified view. It can be seen in these figures that said plate (20) is internally provided with longitudinal side recesses (22; 23) to the inner boundary of which pairs of collapsible metallic hinges (24; 25) are attached by means of three wedges (24*a*; 24*b*; 24*c*) disposed in their own surfaces. Said hinges are of the type usually known, but it should be stressed herein that they can be disposed with their pairs of joints (24') facing recesses (22; 23), the outer limits of which they do not exceed. More specifically, it can also be seen that sliding coupling part (27) has a "U" profile, however one of the parallel surfaces (27*c*) is wider than the other one (27*d*) and the base thereof is provided with two wedge-shaped notches (27*a*; 27*b*) for attachment to side plate (20). In FIG. 8 the plate of cover (30) and cross-section details of its coupling with side plates (20) are shown. It can be seen that cover (30) is provided in its inner surface with a longitudinal recess (31) which is aligned with and perfectly fits into wedge-shaped longitudinal protuberance (26) provided in the upper end of side plate (20). Said fitting is such that it prevents water from entering inside the box, thus eliminating the need of protecting films presently required for state of the art boxes.

The interior of the box shown in FIG. 1 is illustrated in FIG. 10, thus evidencing that all metallic parts are located in the inner portion thereof, thus avoiding further stress thereon as well as the friction caused by the oscillation of the load during the transportation.

It should be pointed out that, despite the fact that FIGS. 1 through 10 shown herein illustrate a box provided with a pair of hinges (24; 25) and a pair of parts (27; 28) and (12'; 13'), the amount and the material for making such elements may vary, depending on the dimensions and closing conditions required therefor.

FIGS. 11 through 17 show a specially preferred embodiment of the inventive box. The following improvements are aimed at in this embodiment:

- outer hinges that allow an overall view of the elements for assembling and disassembling the box;
- outer hinges that allow the operator who assembles and disassembles the box to fully view the coupling/uncoupling operation of the locking rods when the boxes are stacked in great heights;
- hinges having alternating inner/outer attachment above/below the side plate median line which provide more stability to the attachment of side plates to the box and at the same time cut to half the number of hinges;
- lower metallic locking part of side plates stamped as a single body, what provides more mechanical strength thereto; and
- upper recess in the side plate, what makes possible to attain a perfect fitting of the ends of the hinge locking rod and avoids vertical displacements of said rod.

It should be pointed out that despite the fact that this configuration of the box is provided with an outer metallic part, there are only four of them, and they can be fitted into specific recesses so that they do not project from the surface of the side plates.

Figure 15:
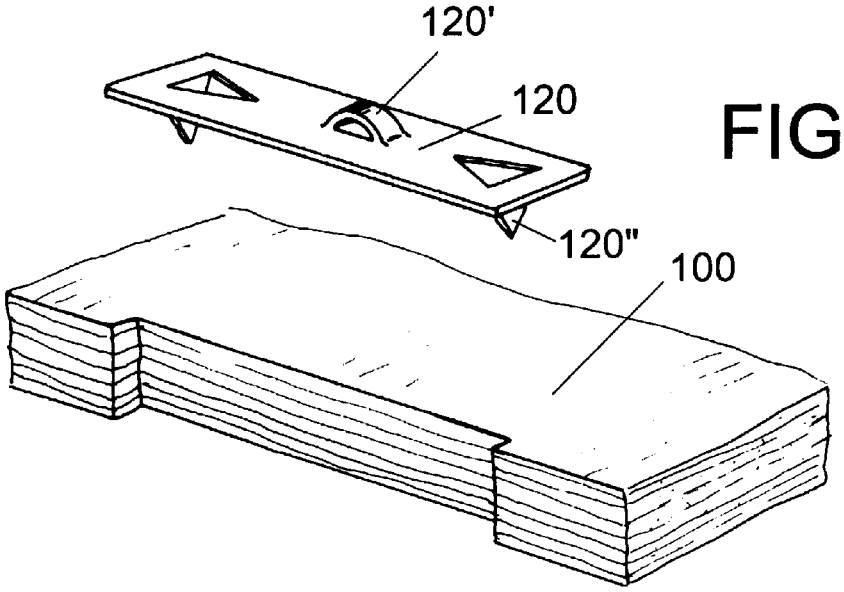
FIG. 15 is a perspective view of preferred embodiment of the metallic locking part.
Figure 16:
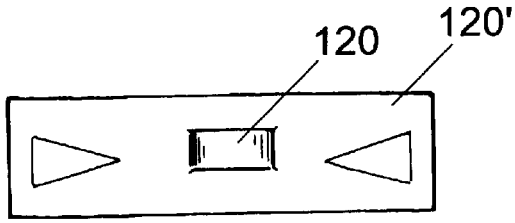
FIG. 16 is a front view of a preferred embodiment of the lower metallic locking part of the side plates.
Figure 17:
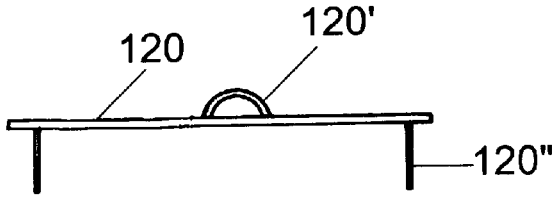
FIG. 17 is a profile view of the metallic locking part a shown in FIG. 16.

According to what is illustrated in FIGS. 11 through 14, it can be seen that in this configuration the box for transporting and storing different products in accordance with the invention is comprised of a side plate structure (200) provided with recesses (210; 220) along its side ends, alternately disposed inside/outside, over which are joints (230'; 240') of respective hinges (230; 240). Said hinges (230; 240) are attached to the same plate (200) in an alternating inner/outer attachment above/below its horizontal median line X. In the upper portion, said plate (200) is provided with a horizontal recess (250) which is sufficient for the upper L-shaped end of rod (400) to fit and be locked therein against vertical displacement. In FIGS. 15 through 17, it can be seen that lower metallic locking part (120) of side plates (200) is provided with an arc-shaped notch (120') in its own surface. Said metallic locking part (120) is attached to base plate (100) of the box by means of small wedges (120') which are also stamped in its own surface. Thus, it is evident that this metallic locking part is made in a single stamping operation.

It should be pointed out that, with this disposition of the parts of the inventive box, which parts are made of anticorrosion metallic material which is otherwise submitted to anticorrosive treatment, all drawbacks found in the main container designs presently in use in the market all over the world are eliminated, mainly those boxes made of plywood which are used for transporting pieces and automotive vehicle parts from the factory to the assembling plant, either by road or rail or sea.

What is claimed is:

1. A box for transporting and storing of products, said box being adapted for the transport of automotive vehicle parts and to be disassembled and restored to its original shape, comprising a pallet-type bottom plate, side plates and upper cover, said side plates being coupled (i) together by pairs of side hinges, and (ii) to said bottom plate by pairs of horizontal sockets in the lower portion that cooperate with respective pairs of locking parts of said bottom plate, wherein said pairs of locking parts are provided with pairs of respective vertical locking pins which slide into respective L-shaped recesses provided in said pairs of sockets, and (iii) to said cover by latches, and by the coupling of wedge-shaped longitudinal protruberances in the upper end portion of said plates to corresponding recesses provided in the inner face of said cover, said pairs of side hinges, said pairs of sockets of said side plates and said pairs of locking parts on said bottom plate, all disposed interiorly of said box without any portion thereof projecting to its outer surface.

2. A box according to claim 1, wherein each pair of side hinges of a side plate fits into a respective pair of side hinges of an adjacent side plate assembly and being joined by a rod.

3. A box according to claim 2, wherein said rod is provided with one L-shaped folded end.

4. A box according to claim 1, wherein said side plates are provided with longitudinal side recesses, and the boundaries of which are said pairs of side hinges.

5. A box according to claim 1, wherein said side plates have a straight base to rest on an insert of said bottom plate.

6. The box according to claim 5, wherein said bottom plate has a surface area which is smaller than the area of said insert and is also provided with recesses in its ends, in the boundaries of which said pairs of locking parts are attached.

7. The box according to claim 1, wherein said pairs of sockets have "U"-shaped profiles provided with two parallel arms, one of said arms being longer than the other of said arms.

8. The box according to claim 1, wherein the side hinges are positioned in the boundaries of said longitudinal side recesses with their joints facing said recesses.

9. The box according to claim 1 and including an outer side closure comprised of: (i) said side plates having lateral vertical recesses along opposite vertical side ends, said side plates having recesses along said opposite side ends, said recesses being located above and below an imaginary horizontal center line dividing said side plates into upper and lower regions, the interior of said recesses housing the joints of said hinges, the upper portion of said side plates being provided with a horizontal recess adapted for housing an L-shaped upper end of a rod that connects the joints of said hinges; and (ii) a lower metallic locking structure for said side plates provided with an arc-shaped notch stamped in its own surface.

* * * * *